United States Patent [19]

Haber et al.

[11] Patent Number: 4,793,342

[45] Date of Patent: Dec. 27, 1988

[54] EMERGENCY SMOKE HOOD AND BREATHING MASK

[75] Inventors: Terry M. Haber, El Toro, Calif.; Romeo Le Marie, Hong Kong, Hong Kong

[73] Assignee: Terry McGovern Gaber, El Toro, Calif.

[21] Appl. No.: 21,274

[22] Filed: Mar. 3, 1987

[51] Int. Cl.[4] ..... A62B 9/04

[52] U.S. Cl. ..... 128/202.27; 128/206.17; 128/206.12; 128/205.24; 128/205.25

[58] Field of Search ..... 128/200.24, 201.22, 128/201.23, 201.24, 201.25, 201.28, 202.21, 205.24, 205.27, 205.25, 205.29, 206.12, 206.21, 206.17, 206.28, 207.17, 206.15, 207.12, 202.27, 205.12–205.17, 207.11; 244/118.5

[56] References Cited

U.S. PATENT DOCUMENTS

| | | | |
|---|---|---|---|
| 3,202,150 | 8/1965 | Miller | 128/205.25 |
| 3,565,068 | 2/1971 | Bickford | 128/201.25 |
| 4,559,939 | 12/1985 | Levine et al. | 128/201.25 |

*Primary Examiner*—Edward M. Coven
*Assistant Examiner*—J. P. Lacyk
*Attorney, Agent, or Firm*—Townsend & Townsend

[57] ABSTRACT

A mask-hood assembly for supplying persons, such as aircraft passengers, with clean air or oxygen during emergency situations such as a cabin depressurization, a fire emergency and when the passenger attempts to escape through a smoke-filled environment. The mask is applied and held against the user's face so that it overlies his nose and mouth and communicates with an emergency oxygen supply system via valving disposed in a two-part housing. During escape attempts the passenger separates the two housing parts, one remaining attached to the emergency oxygen supply system and the other one remaining attached to the mask. Upon separation of the two parts, an activated charcoal filter disposed in the housing part attached to the mask is automatically positioned so that the passenger only inhales air from which particulate contaminants, smoke and/or toxic gases have been removed by the filter. A tightly folded hood is wrapped about the exterior of the mask. It is extended during a fire or smoke emergency by pulling the hood over the passenger's head. The hood includes an elastic band which biases the edges of the hood about the passenger's neck. The hood includes a clear window to provide vision during the escape attempt.

21 Claims, 3 Drawing Sheets

EMERGENCY SMOKE HOOD AND BREATHING MASK

BACKGROUND OF THE INVENTION

This application relates to masks for protecting persons against the dangers of heat, smoke and toxic gases during a fire emergency and more particularly to such a hood adapted to be used, amongst other uses, in conjunction with emerhency oxygen or air supply systems on aircraft and similar vehicles.

It has long been recognized that in fire emergencies incapacitating toxic gases cause many fatalities which could be avoided if the person could avoid inhaling them. This problem is probably most frequently encountered during low impact aircraft crashes, or beely-landings, when the aircraft does not disintegrate upon impact and encounters damage without completely disintegrating. During such crashes, many or all of the passengers on board survive the initial impact but they are killed by the ensuing fire. The National Transportation Safety Board recently summarized, as follows, the sequence of events surrounding a commercial airline crash in which the sircraft belly-lands.

Initially the aircraft skids along the ground. This shreds fuel lines in the lower fuselage of the aircraft and sprays a fine mist of jet fuel into the baggage compartment. Typically, one of the wings brushes the ground, a wing tank ruptures and more fuel mist sprays out. A spark generated by the aircraft's crushing, skidding underside ignites the vapor and a fireball envelopes the lower fuselage and the wing touching the ground.

Within 30 to 60 seconds of the initial impact, the aircraft comes to a full stop, still level and intact. The flames on the side of the aircraft with the ruptured wing begin to melt the acrvlic polymer windows and begin to burn through the fuselage.

During the next minute, that is within about 60 to 120 seconds of the initial impact, a portion of the aircraft's interior is ablaze and the cabin begins to fill with a dense, black, acrid smoke. Seat cushions begin to catch fire and the smoke in the cabin stings the passengers' eyes shut. The smoke and poisonous gases incapacitate the weak and elderly almost immediately and the other passengers shortly thereafter. Passengers who are still conscious blindly attempt to crawl toward an exit which, quite typically, is not visible because of their shut eyes.

After about two minutes from the initial impac the cabin is an inferno. All passengers remaining in it are asphyxiated by smoke, poisoned by toxic gases and incapacitated, that is unconscious and unable to move. Thereafter, they are burnt to death by flames.

There are indications that a substantial number of passengers in low impact aircraft crashes could be saved. Studies have shown that between 1969 and 1983, over 60% of the fatalities in such crashes were not caused by impact, but by suffocation due to the inhalation of toxic fumes and smoke. For example, the majority of the 583 passengers who died at the Tenerife (Canary Islands) disaster of 1982 expired from smoke and toxic gas inhalation and not from burns. Further, studies have shown that over 80% of the passengers who died by fire are not burned to death instantly. Instead, they are first felled by inhalation of smoke and gases emitted by the burning cabin materials, and thus are unable to escape.

One of the major contributors to the almost insurmountable odds against survival faced by surviving passengers in burning aircraft are the dense, blinding smoke emitted by polyurethane seat cushions. These cushions ignite easily and emit such lethal gases as acrolein, phosgene, carbon monoxide, surphuric acid and hydrogen cyanide.

Many of these fatalities could be prevented if the passengers' heads, typically the only fully exposed part of their bodies, could be protected from the hostile environment and if the breathing air could be cleansed of toxic and choking ingredients by providing each passenger with a protective hood and a breathing mask which he could take with him during his escape attempt after he leaves his seat. For a variety of reasons, this has not happened in the past. In part, this is believed to be due to impractical designs. In part this is due to the high cost of the required cabin modifications to accommodate such masks. Lastly, this is also due to the inability of existing smoke hoods to provide the required head protection and air cleansing. The applicants are advised that studies have determined that it would be over 20 times more expensive for airlines to implement the use of existing smoke hood-breathing mask designs than to pay the average $500,000.00 death settlement to the survivors of persons who perish in aircraft crashes.

SUMMARY OF THE INVENTION

The present invention provides a simple, effective breathing mask-smoke hood combination (hereinafter often referred to as an "escape mask") which, in a fire emergency such as often encountered immediately following a low impact aircraft crash, protects the passenger's head from the hostile environment in the cabin and assures that the passenger breathes non-toxic air. The escape mask allows the passenger to keep his eyes open during an escape attempt after he leaves his aircraft seat. The escape mask of the present invention can be used in exactly the same manner as conventional aircraft emergency oxygen supply masks, such as disclosed in U.S. Pat. No. 3,467,093, for example, during times when there is no fire emergency, e.g. during a cabin pressure loss. Moreover, the escape mask of the present invention is compact, relatively inexpensive and it can be stowed in existing aircraft oxygen mask storage compartments. Thus, the escape mask of the present invention can be installed with relatively little cost in all existing aircrafts.

Generally speaking, escape mask comprises a mask or mouthpiece which is connected to the aircraft's emergency oxygen supply in a conventional manner, for example, generally along the lines described in the above-referenced U.S. patent. Should the passenger require additional oxygen, for example during a depressurization of the cabin, the mask drops from the compartment, is strapped over the passenger's head so that it covers his mouth and nose, and the passenger continues to breathe normally the air or oxygen supplied by the emergency system while he remains seated in his seat.

In a fire emergency, however, following a low-impact crash, for example, the passenger's survival depends on his ability to quickly reach and escape through an aircraft exit. This requires that he leaves his seat and, therefore, requires that he becomes disconnected from the aircraft's emergency oxygen supply, should that still be operating. The escape mask of the present invention enables such an escape in the following manner.

The mask is constructed in two parts, a part permanently attached to the aircraft's emergency oxygen supply system and a filter part permanently attached to the mask placed over the passenger's mouth and nose. This part carries within itself an activated charcoal filter, or another filter capable of cleansing the passenger's breathing air of toxic gases and choking fumes, which is automatically activated upon the separation of the two mask parts.

Further, the filter part of the mask includes a folded hood constructed of a heat resisting material, such as metalized Mylar, which can almost instantaneously be pulled over the passenger's entire head and which is constructed so that it fits relatively tightly around the passenger's neck. The hood includes a high temperature resistant window through which the passenger can view the interior of the cabin. The hood and window are constructed in such a manner that they do not noticeably deteriorate at elevated temperatures of say about 300° F. for a limited period of time, say about ten minutes.

As soon as the two mask parts are separated, the passenger alights from his seat and proceeds towards the closest emergency exit with his eyes open. He is able to continue to breathe cleansed non-toxic, non-choking air. Thus, the escape mask shields him from becoming incapacitated due to poisoning, asphyxiation or blinding. His chances of reaching the exit before he is burnt to death are thereby greatly enhanced. This is particularly true in view of the fact that the clothing worn by the passengers is an excellent heat insulator. The heat resistant and heat-reflecting hood of the present invention now also protects the passenger's head against burning. The layer of air between the hood and the passenger's head increases the heat protection afforded by the hood of the present invention.

Aside from the life-saving benefits afforded by the hood of the present invention, it has the further distinct advantage of being cost-effective. It requires no modification of the interior of the aircraft. Its cost is only modestly higher than the cost of conventional oxygen emergency masks presently used on all aircrafts. Thus, there is now a real incentive for operators of aircraft to use the escape mask of the present invention as a life-saving protection for its passengers because the additional cost of the mask is only a fraction of the cost that must be paid to survivors of aircraft crash victims.

DESCRIPTION OF THE PREFERRED EMBODIMENTS

Figure 1:
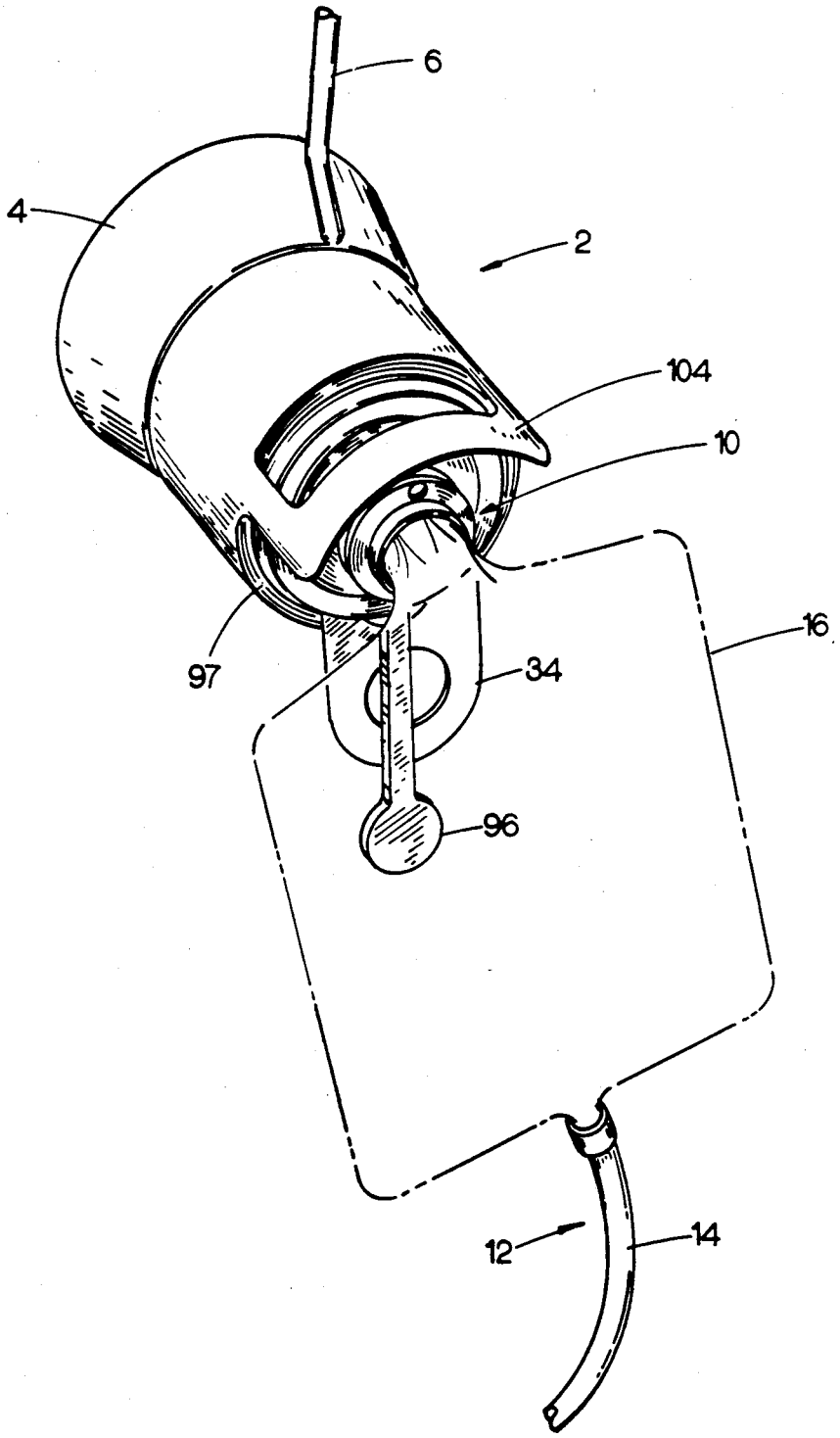
FIG. 1 is a perspective, elevational view of an emergency mask-hood constructed in accordance with the present invention.
Figure 2:
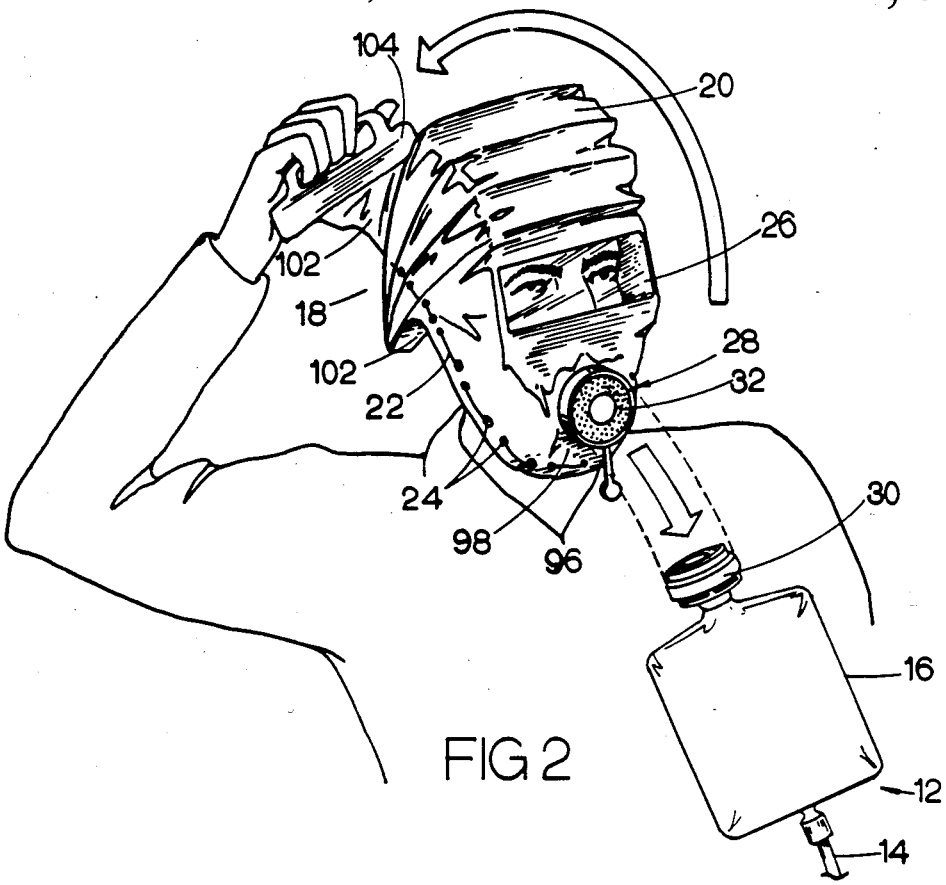
FIG. 2 is a side elevational view, similar to FIG. 1, and illustrates the manner in which a person applies the hood and separates the mask from an emergency oxygen supply system of an aircraft, for example.

Referring first to FIGS. 1 and 2, a combined hood-mask assembly, or escape mask 2 constructed in accordance with the present invention generally comprises a mouthpiece or mask 4 which, during use, overlies the passenger's nose and mouth and is resiliently pressed against his face by means of an elastic band 6. The mask preferably has a frusto-conical cup shape and its larger end preferably includes an inwardly turned sealing rim 8 which, during use, seats against the passenger's face. The cup is preferably constructed of a resilient, rubber-like material and the sealing rim 8 has a relatively thin wall cross-section so that it readily conforms to the contour of the passenger's face surrounding his nose and mouth. Generally speaking, the mask is constructed as described in U.S. Pat. No. 3,467,093 and may, but need not incorporate the nestable characteristics for the mask described therein.

Attached to the mask 4 is a two-piece valve-filter assembly 10, the downstream or filter part of which is connected to the mask in a manner further described below. An upstream part of the valve-filter assembly is fluidly connected to an emergency air or oxygen supply system 12, such as are commonly installed on commercial aircrafts. The emergency air supply system may, for example, comprise an air supply tube 14 to which is joined an inflatable air storage bag 16 which, in turn, is fluidly connected to the upstream part of the valve-filter assembly as is further described below.

The escape mask 2 of the present invention further includes a hood assembly 18 which primarily comprises a hood 20 that is configured to be placed over a passenger's entire head and which is of a sufficient size so that it surrounds his neck when extended. A resilient band 22 threaded through multiple eyelets 24 along the edge of the hood (when opened, as illustrated in FIG. 21 gently biases the hood edges towards the passenger's neck. Hood 20 includes a transparent window 26 and during non-use, i.e. in its storage configuration, the hood is folded in an accordion-like manner about the periphery of valve-filter assembly 10.

To briefly summarize the manner in which the escape mask of the present invention is used on an aircraft, for example, it is conventionally stowed away in overhead compartments above each seat on the aircraft. While stowed, the hood is folded about the valve-filter assembly and no air or oxygen flows through the emergency air-oxygen supply system 12 of the aircraft. In case of a cabin depressurization, for example, when passengers need additional air or oxygen, the escape hood automatically drops from the storage compartments in a conventional manner and the passenger places the mask over his face as is commonly demonstrated on almost all of today's commercial aircraft flights so that the sealing rim 8 of mask 4 engages the passenger's face and the mask overlies his mouth and nose. At this point, air or oxygen is automatically supplied to the mask via the supply system 12 and the passenger inhales air supplied by the system and exhales in a manner described in further detail below.

In the event there is a fire emergency, generating heat, smoke and/or toxic gases, the passenger opens the hood and extends it over his head (while the mask 4 remains seated over his mouth and nose) in a manner more fully described below. Once the hood is applied, it protects the passenger's head against heat and direct contact with the hostile atmosphere that may exist in the aircraft cabin. The escape hood 2 of the present invention further protects the passenger against inhaling smoke and/or toxic gases during an escape attempt.

To accomplish this, the valve-filter assembly 10 includes a downstream or filter part 28 which is attached to mask 4 and an upstream part 30 which is attached to air bag 16. The filter part is fitted with a filter 32 and can be separated from the upstream part by pulling a release handle 34 in a manner more fully described below.

Once the two parts of the valve-filter assembly are separated, the passenger inhales cabin air through filter 32 which removes therefrom particulate and toxic substances and fumes. Upon the separation of the two parts the passenger is able to alight from his seat and proceed towards an emergency cabin exit. During this time, the extended hood 20 protects the passenger from heat that may be generated by a cabin fire, for example, window 26 in the hood provides visibility for him, filter 32 enables him to inhale air without choking or the danger of poisoning, and the hood, closed about the passenger's neck, protects his face and particularly his eyes from the stinging effects of smoke and gases that may be generated by the fire. He is now in a position to view the cabin, locate the exit and proceed towards it.

As the foregoing brief summary demonstrates, unlike conventional emergency masks for supplying airline passengers with oxygen, as described in the above-referenced U.S. Pat. No. 3,467,093, for example, which are strictly limited to providing air to the passenger while in his seat, or in the immediate vicinity thereof, the escape mask of the present invention additionally protects the passengers entire head against both heat and a hostile atmosphere which may exist in the aircraft cabin. This is of great significance because during a fire emergency a passenger's head is typically the major part of his body which is entirely unprotected against heat and the prevailing atmosphere, the remainder of his body being at least temporarily protected against heat by the insulating effect of his clothing.

Further, and also in addition to the assistance afforded by masks such as the one disclosed in the above-referenced U.S. patent, the escape mask of the present invention provides the passenger with treated breathing air while he is remote from his seat, e.g. during an attempt to escape from the cabin. Thus, the escape hood of the present invention gives passengers in emergencies, particularly emergencies involving fire which inside aircraft cabins generate large amounts of smoke and toxic gases, an opportunity to escape before they are killed by heat.

Prior art masks failed in this regard entirely, at best they provided the passenger with air while he remained seated. To escape, the passenger had to disconnect himself from the aircraft's emergency oxygen supply system and expose himself to the debilitating effects of smoke and toxic gases. As is well-known and as was described in some detail at the beginning of this application, the choking and blinding effects of smoke, and especially the poisoning effects of toxic gases in the cabin, typically incapacitate the passenger within moments after he disconnects himself from the aircraft's oxygen supply system. Once incapacitated, the passenger has no possibility of escaping the ensuing heat and death results in almost all instances.

Referring now to FIGS. 1–4, the valve-filter assembly 10 of the present invention comprises the earlier mentioned first and second parts which are cylindrical in cross-section and axially joined. The downstream end of the filter part 28 is defined by a flange plate 36 which includes a radially oriented, outwardly open groove 38 into which mask 4 extends. The groove width and mask thickness are selected so that the mask is securely, frictionally retained to the flange plate. If desirable, the connection can be enhanced by applying a suitable bonding agent. The flange plate includes a central through-bore 40, which establishes communication with the interior of an enlongated tube 41 concentrically disposed about the through-bore and extending forwardly, or in an upstream direction from the flange plate. The tube may be integrally constructed with the flange plate, or it may be secured thereto as by bonding, for example. The upstream end of the tube is closed by a disk 42. The tube further includes two sets of radial holes, a first, upstream set 44 proximate the disk 42 and a second, downstream set of holes 46 which are axially spaced some distance from the disk.

Filter part 28 further includes an annular spacer 48 having an L-shaped cross-section which engages an upstream oriented surface 50 of flange plate 36. The spacer surrounds tube 41 and defines an annular exhaling space 52 that is bound by the flange plate, the tube and the annular spacer. The annular space 52 fluidly communicates with central bore 40 in the flange plate via a series of exhalation passages 54. The annular space further communicates with the exterior of the filter part via a multiplicity of radially oriented exhaust ports 56. Thus, there is established a passage for exhaled air from the interior of mask 4, then sequentially through part of central bore 40, exhalation passages 54, annular space 52, and exhaust ports 56 to the exterior of the mask.

A filter housing 58, which also has a generally L-shaped cross-section, is disposed about tube 41, positioned upstream of annular spacer 48 and is open in an upstream direction. The housing defines an annular space between the exterior of tube 41 and its peripheral wall 60. The filter 32 is annular in cross-section slidingly engages tube 41 and the interior wall 60 of the filter housing. Further, the filter has a thickness less than the length of the filter housing wall 60 as is more fully described hereinafter. A plurality, say 4 or 6 equally spaced compression springs 62 are disposed between the downstream of filter 32 and the opposing interior end surface 64 of the filter housing. The springs urge the filter in an upstream direction in a manner more fully described below.

In its fully assembled state, the filter part 28 also includes hood assembly 18, comprising hood 20, window 26 and resilient hood band 22. The hood is folded in an accordion fashion, as clearly shown in FIG. 3, and an unfolded portion thereof extends into the space between annular spacer 42 and filter housing 58. The filter housing is secured to the annular spacer with suitable fasteners, such as rivets (not shown) which extend through the spacer, the portion of the hood between the spacer and the housing, and the housing. Alternatively, the annular spacer, the filter housing and the portion of the hood disposed between them can be bonded to each other with an adhesive, by heat bonding, or the like. The portion of the hood disposed between the annular spacer and the filter housing includes a cutout, not separately marked in the drawings, through which tube 41 extends.

Lastly, filter part 28 of the valve and filter assembly includes a stop plate 66 attached, e.g. bonded to end disk 42 of tube 41. The stop plate slightly protrudes radially past the periphery of the tube. It thus limits the extent to which compression springs 62 can move filter 32 axially in an upstream direction for purposes further described below.

Figure 3:
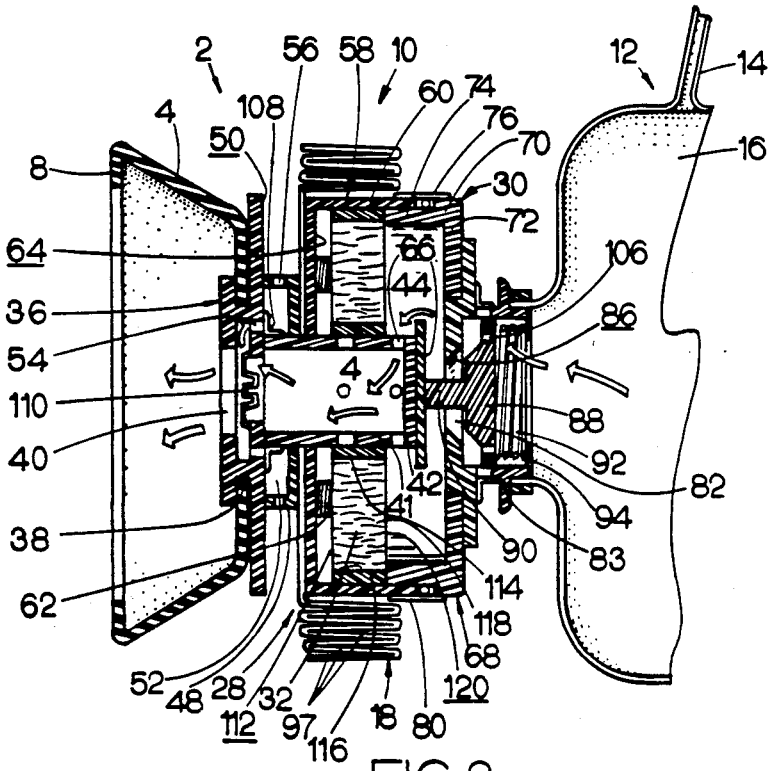
FIG. 3 is an enlarged, plan view, in section, through a hood-mask constructed in accordance with a first embodiment of the present invention.

The upstream part 30 of valve and filter assembly 10 includes a filter housing cover 68 which has a cylindrical wall 70 joined to a transverse cover plate 72. A downstream portion 74 of wall 70 is recessed so that it slidably extends into filter housing 58. The length of the recessed portion is chosen so that it axially moves filter 32 sufficiently in a downstream direction against the force generated by compression springs 62 to uncover the upstream set of holes 44 in tube 41 while it completely covers downstream holes 46, as is illustrated in FIG. 3. Adhesively coated tape, such as Mylar tape 76, is wrapped about the exterior of housing 58 and cover wall 70, is approximately centered midway between them, and retains the two to each other during storage of the escape mask.

When fully assembled, housing 58 and cover wall 70 form a narrow groove between them into which is placed a length of string 80, wire, fiber monofilament or the like which is also guided through an axially oriented slot 78 in wall 70. The end of string 80 depending from the axial slot 78 is attached to pull-handle 34. When the handle is pulled downwardly (as seen in FIG. 1) it first severs the portion of Mylar tape 76 overlying the axial slot 78. Thereafter, further pulling on handle 34 along a generally circular path about the valve-filter assembly 10 severs the tape along the groove between the filter housing and the cover wall. When the entire tape has been severed in this manner, the axial force exerted by compression springs 62 pushes filter 32 in a downstream direction until it engages stop plate 66. This motion of the filter ejects cover 68 from filter housing 58 and thereby separates the two parts of the valve-filter assembly for purposes further described below. To assure a cutting of the tape 76 by string 80, the end of the string disposed in the groove is suitably anchored, for example by bonding it to the groove or applying two or three string windings to the groove to frictionally engage the string therein.

Cover 68 includes a central bore 82 which communicates with a tubular end flange 84 to which air bag 16 of the emergency air-oxygen supply system 12 is suitably secured as, for example, with a circular clamp 84. Alternatively, the filter bag may be secured to the end flange in the manner generally described in U.S. Pat. No. 3,467,093.

Figure 4:
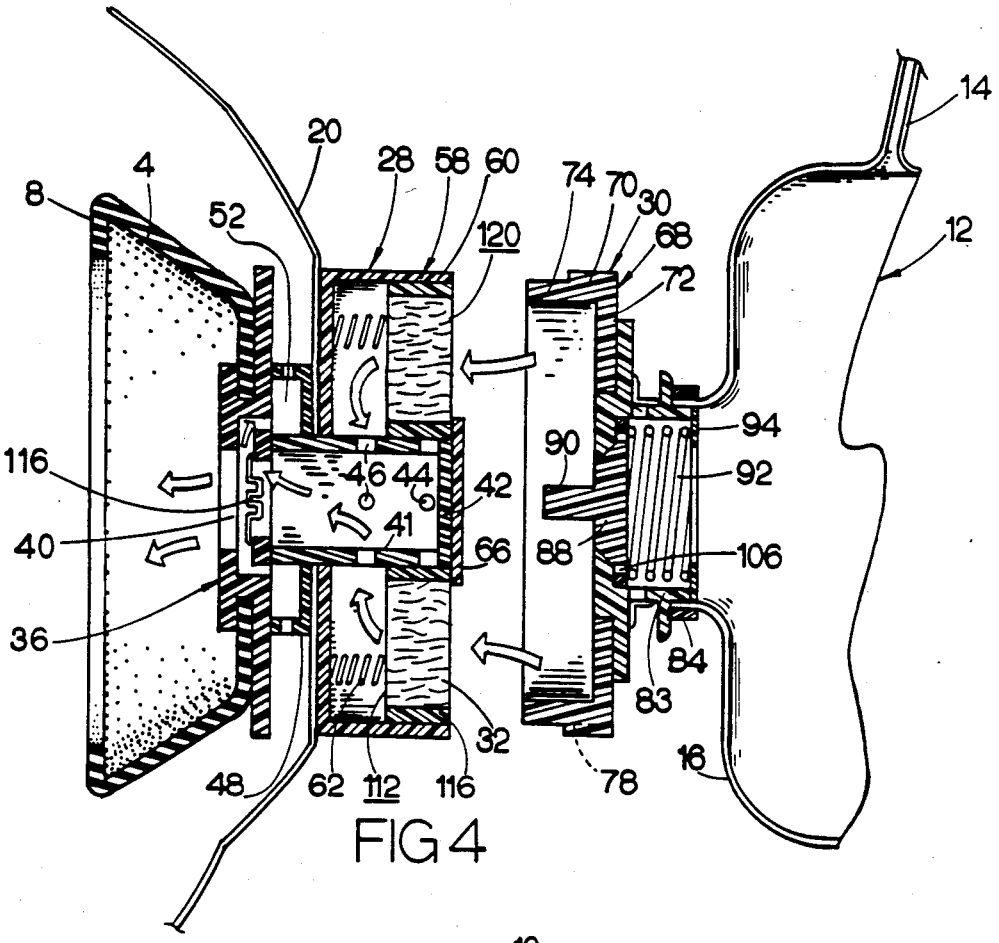
FIG. 4 is a plan view, in section, similar to FIG. 3, and illustrates the operative condition of the two parts of the mask of the present invention after they have been separated, during a fire emergency, for example, to enable the passenger to escape from his seat through an exit door through the exterior of the aircraft, for example.

In one embodiment of the invention, the bore 82 through cover 68 includes an upstream facing, tapered section 86. A valve plug 88 which has a correspondingly tapered valve seat and an axial stem 90 which extends from the valve seat in a downstream direction, is disposed on the upstream side of the cover and at least partially within the tubular end section 83. The spring urges the valve plug in a downstream direction so that it seats against the tapered bore section 86 when the cover is separated from filter housing 58 as is illustrated in FIG. 4. A retaining ring 94, which may be secured to the end of the tubular end section 83, or which may be disposed within an inwardly facing axial groove (not shown) in the end section supports the upstream end of the spring.

Still referring to FIGS. 1–4, an elongated handle 96 is rigidly attached to and projects radially from the filter housing 58. It is oriented relative to hood 20 so that the handle projects downwardly when the hood is applied over the passenger's head. Thus, handle 96 projects from that part of filter housing 58 which is proximate to the relatively short portion 98 of the hood (illustrated in FIG. 2 only) which, during use, extends over and about the passenger's chin.

The remainder of the hood, that is the major portion thereof which includes window 26 is, during non-use of the hood, folded in a accordion-like fashion into relatively narrow, zig-zag shaped folds 97 (illustrated in FIG. 3) which are tightly wrapped about the exterior of the housing so that the ends 100 of the folds (shown in a partially extended configuration in FIG. 2 only) do not interfere with the downwardly protruding handle 96. When folded, relatively easily severed adhesive tape (not shown in the drawings) interconnects the fold ends 100 and thereby retains the hood folds 97 in a tight, crescent-shape about the exterior of filter housing 58. To accommodate the handle 96 projecting downwardly from the housing and disposed between the fold ends, the adhesive tape may be suitably notched (not shown).

Further, the last fold 102 of hood 20 is fitted with a handle 104, which may be integrally constructed with the hood or secured, e.g. bonded thereto. The handle is of a sufficient size so that it is readily grasped by a user (as illustrated in FIG. 2) and it has sufficient strength relative to the adhesive tape interconnecting the hood fold ends 100 so that the user, when pulling on the handle, breaks the tape. Once the tape is broken the user pulls handle 104 rearwardly and thereby extends the hood over his head until the hood edge, with the elastic band 22, surrounds his neck. Upon release of the handle, the elastic band contracts the edge of the hood and gently biases it against the user's neck.

It is presently preferred to construct the hood of metalized Mylar film. Such film has good resistance against heat and its deflective characteristic helps to protect the user's head from radiant heat. In the presently preferred embodiment of the invention, the window is given a width equal to the width of one hood fold 97 and it is constructed of an acetate which is clear and remains clear even at relatively high temperatures of up to about 300° F. for at least about ten minutes before it deteriorates sufficiently to impair visibility through it. The window may be secured to the hood in any of a number of ways such as, for example, by bonding, taping, or preferably, by heat-sealing it to the hood.

The hood should be constructed sufficiently large so that it readily fits over the passenger's head including voluminous hairdos he or she might have. This serves a dual purpose. First, it facilitates the quick and easy extension of the hood over the passenger's head. Second, the relatively large hood traps a substantial amount of air inside it. This air is a heat insulator which protects the passenger's head from the elevated temperature prevailing in the aircraft cabin. The clear air surrounding the passenger's head further assures good vision through the window.

Turning now to the manner in which the escape mask 2 illustrated in FIGS. 1–4 is used, during non-use, when it is stowed away in overhead compartments above aircraft seats, for example, the hood is fully folded and wrapped about the exterior of filter housing 58 as is best illustrated in FIG. 1. The adhesive tape (not shown) keeps the hood folds' ends attached to each other and tightly wrapped about the filter housing. Since metalized Mylar is exceedingly thin, typically it has a thickness of only a few thousandths of an inch, the folded hood only marginally extends beyond the periphery of the filter housing. Its outer diameter typically is no greater than the outer diameter of mask 4.

In this storage configuration of escape mask 2, the valve-filter assembly 10 is fully assembled, that is tape 76 constrains the two parts of the assembly to each other and air bag 16 of the emergency oxygen supply system 12 is attached to the tubular end section 83 of the assembly.

When additional oxygen (or air) is required by the passengers, for example during a cabin depressurization, an escape hood 2 of the present invention will drop from the overhead compartment in the aircraft and the passenger conventionally applies the mouthpiece 4 over his mouth and nose. Plastic band 6 retains it in this position. The passenger now breathes normally through the mask, inhaling air or oxygen supplied by the emergency system 12 and entering the valve-filter assembly from air bag 16 through the tubular end section 83 thereof as is illustrated by the arrows in FIG. 3.

In this position, plug valve 88 is open because valve stem 90 rests against stop plate 66 at the end of tube 41 and is pushed against the force exerted by compression spring 92 so that the valve plug is spaced from the tapered section 86 of bore 82 in cover 68. To enable the passage of air past the valve plug, it includes a plurality of air passage holes 106 which are arranged radially outward of the tapered section. Air entering the interior of cover 68 then passes through the upstream set of holes 44 in tube 41 to the interior of the tube, also as indicated by arrows in FIG. 3. From the tube, air flows in a downstream direction past central bore 40 in flange plate 36 and hence through mask or mouthpiece 4 to the passenger.

To prevent ambient air, smoke, toxic gases or the like from entering the mask during the inhalation phase, a resilient, L-shaped valve band 108 is disposed in the annular space 52. It overlies exhalation passes 54 and is drawn against the upstream face 50 of flange plate 36 by the relatively lower pressure prevailing inside mask 4 during the inhalation phase as compared to the ambient pressure which prevails in the annular chamber 52. The leg of the valve band surrounding tube 41 can be fixed, e.g. bonded to the exterior of tube 41, for example, while the other leg is free and overlies the exhalation passes 54.

During the exhaling phase, the relative pressure prevailing within mask 4 increases and exhaled air is discharged by flowing through exhalation passes 54. The increased air pressure prevailing inside the mask deflects the leg of valve band 108 overlying the exhalation passages and thereby opens the latter. The exhaled air now escapes to the surrounding atmosphere through exhaust ports 56.

Exhaled air is also discharged from inside mask 4 past the sealing rim 8 of the mask because the sealing rim only forms an incomplete or partial seal with the passenger's face. Thus, clean air is continuously supplied into the space between hood 20 and the passenger's head. This keeps out fumes, smoke, etc. and assures continued good visibility through the hood window 26 while protecting the passenger's eyes from the stinging effect of the smoke.

In one embodiment of the present invention, especially adapted for use with emergency air or oxygen supply systems 12 which operate at a pressure of approximately 0.1 atmosphere above the ambient pressure, no valves are required to prevent the exhaled air from flowing back into the air bag 16. This is due to the fact that there is a significant pressure loss between the air bag and the interior of mask 4 by virtue of the air passages through tube 41, through cover 68 and plug valve 88. For instances, however, when the pressure differential between the mask, during the exhaling phase, and the air bag is insufficient to prevent significant amounts of exhaled air from being returned to the air bag, a check valve 110 may be mounted to flange plate 36. In a preferred embodiment of the invention, the check valve is generally as disclosed in the above-referenced U.S. Pat. No. 3,467,093.

Briefly, such a check valve is defined by a valve disk constructed of a resilient material such as rubber, for example. The valve disk is secured to a spider (not shown, but shown, illustrated and clearly described in the referenced U.S. patent) which may be affixed, for example, to flange plate 36 or tube 41. It overlies the central bore 40 through the flange plate so that its peripheral edges engage a suitably formed seating surface on the plate as is generally illustrated in FIGS. 3 and 4 of this application. The check valve, during the exhaling phase, closes off the interior of tube 41 from the mask. Thus, exhaled air is forced to flow to the exterior either past band valve 108, annular space 52 and exhaust ports 56 and/or it flows beneath hood 20 between the passenger's face and mask sealing rim 8.

During the inhaling phase the relatively lower pressure prevailing in mask 4 cause the relatively higher pressure from the air supply system 12 on the interior of tube 41 to open check valve 110 and permit an air flow in a downstream direction into the mask.

It should be noted that handle 96 assures that the passenger properly applies the mask to his face in an orientation in which the handle points downwardly and the hood handle 104 is on the upwardly oriented section of the filter housing 58. It is a relatively simple manner to instruct the aircraft passengers to apply the mask so that the handle points downwardly who readily memorizes the instruction. In addition, the passenger recognizes immediately that a downwardly extending handle facilitates the manipulation of the filter section 28, and therewith of the mask, since it is more difficult to grasp the handle if it extended upwardly when the mask is applied over his face.

With the handle 96 in its proper downward orientation, the entire mask is properly positioned for use in case of a fire and/or smoke emergency. If that should be present, the passenger grasps hood handle 104 and pulls upwardly thereon to break the adhesive tape holding the folded ends 100 together. Thereafter, he extends the hood over his head in the manner described above. While he remains in his seat, he can continue inhale air or oxygen supplied through air bag 16.

If the passenger must leave his seat, to escape from the cabin through an exit, he pulls on handle 34 downwardly in the above-described manner to separate the two parts of the valve and filter assembly 10. This "disconnects" the passenger from the emergency oxygen supply system and automatically activates filter 32 because compression springs 62 force the filter along tube 41 in an upstream direction until the filter engages stop plate 66. From this point on, any air inhaled by the passenger will be the prevailing cabin air which can enter mask 4 only by first flowing through the filter. In the filter, the air is cleaned of particulate, asphyxiating and/or toxic substances. Air exiting the filter on a downstream side 112 thereof then flows through the downstream holes 46 in tube 41 and hence into the mask and to the passenger as is illustrated by the arrows in FIG. 4.

In this mode of operation, air is exhaled as described above. Check valve 110 is not normally needed because band valve 108 is constructed so that it opens at a pressure differential which is less than the pressure differential between the mask and the exterior required to overcome the resistance against upstream flow provided by filter 32. Moreover, a reverse flow through the filter is typically not objectionable. However, the mask works equally if check valve 110 is present in the manner fully described above.

For best results, filter 32 is an activated charcoal filter. Activated charcoal is particularly effective for removing particulates contained in smoke, for example, and toxic gases from the air. However, other filters, including filters especially adapted for the removal of toxic or otherwise objectionable substances from the atmosphere that may be encountered in a particular environment may be substituted for activated charcoal. Such filters are well-known in the art and are, therefore, not further described.

Since the activation of charcoal is lost through prolonged contact with oxygen, e.g. through the exposure of the filter to air, one embodiment of the present invention contemplates to seal the activated charcoal from the air during non-use and until the two parts of the valve and filter assembly 10 have been separated. In the embodiment illustrated in FIGS. 1–4 of the invention, this is accomplished by placing the filter inside a thin, annular cartridge defined by radially spaced inner and outer bushings 114 and 116, respectively. The bushings are in sliding engagement with the exterior surface of tube 41 and the interior of filter housing wall 60, respectively, and they prevent the exposure of the activated charcoal to any air that may be present there. The downstream side 112 of the filter is prevented from coming in contact with air because the inner radial filter cartridge wall 114 seals off the downstream holes 46 in tube 41 so that no air can flow into the space between the downstream side of the filter and the housing surface where compression springs 62 are located.

Lastly, a thin, air impervious membrane 118 is applied to the upstream facing side 120 of the filter. In a preferred embodiment the peripheral portions of the membrane are bonded to the end of recessed cover wall portion 74. The radially inner portion of the membrane is sealed to the upstream end of inner filter bushing 114, so that it is readily separated therefrom when the two parts of the valve and filter assembly are separated. In other words, the bond between the membrane and the cover is significantly stronger than the seal between the membrane and the inner bushing, so that the membrane moves away from filter 32 and is ejected with the cover 68 when it is separated from the filter housing 58.

Once the two parts of the valve and filter assembly 10 are separated, spring 92 urges plug valve 82 against the tapered section 86 of bore 82 in cover 68. This prevents the escape of air or oxygen from air bag 16 to the surrounding atmosphere, e.g. into the aircraft cabin. This is desirable to conserve oxygen in the emergency system for other passengers for example, and/or to prevent oxygen from possibly fueling flames in the cabin. It should be noted, however, that plug valve 88 is not required for the proper use and operation of escape hood 2 of the present invention.

Once the two parts of the valve-filter assembly are separated, the passenger is free to move about the cabin and towards an emergency exit. Although he breathes air from the smoke-filled cabin, the air which reaches him is cleansed by the activated charcoal filter 32. He has clear visibiity of the cabin through hood window 26 and handle 96 on filter housing 58 permits him to readily adjust the mask and hood so that mask 4 properly fits over his mouth and nose, hood window 26 is aligned with his eyes, etc.

Figure 5:
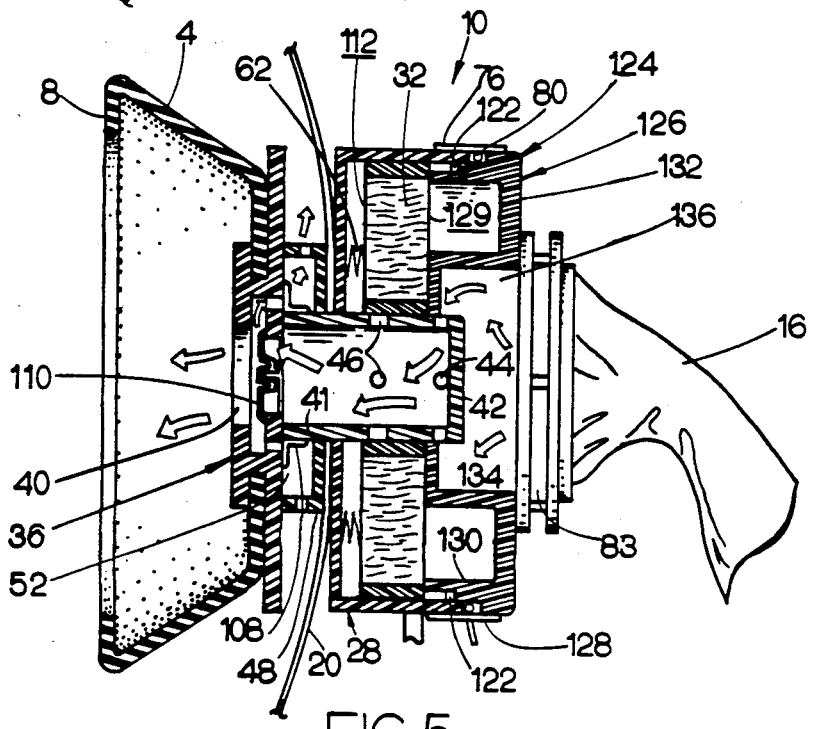
FIG. 5 is a fragmentary, plan view, in section, similar to FIG. 2 but illustrates another embodiment of the present invention.

Referring now to FIGS. 1, 2 and 5, another embodiment of the present invention employs a modified valve-filter assembly 10 for the escape hood. In all other respects the escape hood is the same as the one previously described and the same reference numerals are used in the drawings. Specifically, the valve-filter assembly is again of a two-part construction and includes a filter part 28 which is identical with filter part 28 illustrated in FIGS. 3 and 4, except that the stop plate 66 at the end of tube 46 illustrated in FIGS. 3 and 4 is omitted so that the tube 41 has a constant exterior diameter all the way to its upstream end at disk 48. As a functional replacement for the stop plate the filter part 28 illustrated in FIG. 5 includes a plurality, say three or four equally spaced stop pins 122 which limit the extent to which filter 32 can travel in an upstream direction from the position it is shown in in FIG. 5 when the upstream part 124 of the filter assembly is removed. The pins are positioned so that the upstream face 120 of the filter can move in an upstream direction, as urged by compression springs 62 into approximate alignment with the upstream facing side of disk 42. In this position, filter 32 overlies and thereby encloses the upstream set of holes 44 in tube 41 while it opens the downstream holes 46. The passenger now inhales air cleansed by the filter in the manner described above.

The upstream part 124 of the valve-filter assembly is defined by a cover 126 which has a peripheral wall 128 including a recessed portion 130 which extends into filter housing 58 to a point where the filter uncovers the upstream set of holes 44 in tube 41 while it closes and, therefore, prevents the passage of air through downstream holes 46. Cover 126 also includes a transverse cover plate 132 which extends radially inward from the peripheral cover wall 128. However, unlike the cover plate shown in FIGS. 3 and 4, it includes a radially inwardly located, cylindrical recess which projects in a downstream direction and includes a sealing plate 134 which rests against the upstream side 120 of the filter. The downstream facing side of the sealing plate is in axial alignment with the downstream end of recessed wall portion 130 so that it too engages the upstream side of the filter. The sealing plate 134 has a thickness so that it clears, i.e. leaves unobstructed the upstream set of holes 44 in tube 41. Consequently, when the valve-filter assembly 10 shown in FIG. 5 is fully assembled, that is when adhesive Mylar tape 76 secures the two parts of the assembly to each other in the manner described above, there is an air flow passage from an intake space 136 of the cover 126, though upstream holes 44 into tube 41 and hence to the mask through central bore 40 in flange plate 36. The air intake space in the cover communicates with the emergency air-oxygen supply system 12 via tubular end section 83 which protrudes in an upward direction from cover 126 and air bag 16 attached to the tubular end section in the manner described above.

The escape hood illustrated in FIG. 5 is used in exactly the same manner as the one illustrated in FIGS. 3 and 4. When only additional air or oxygen is required, for example, during a cabin depressurization, the mask is conventionally strapped to the passenger's head. During a fire emergency the hood 20 is extended over the passenger's head, again as was described above. Should the passenger wish to escape he separates the two parts of the valve-filter assembly by pulling on the handle (not shown in FIG. 5) to which the string (not shown in FIG. 5) is attached. This cuts Mylar tape 76 and permits compression springs 62 to push the filter 32 in an upstream direction, thereby ejecting cover 126 and separating it from filter housing 58. The upstream travel of the filter along tube 41 terminates when the upstream side 120 of the filter engages stop pins 122 which protrude radially from the cylindrical wall in housing 58.

The sealing plate 134 of cover 126 employed in the embodiment illustrated in FIG. 5 effectively seals the upstream side 120 of filter 32 against coming into contact with ambient air during non-use and storage. All other sides of the filter are sealed from air in the same manner as was described above. Thus, in this embodiment of the invention, the impervious membrane to seal the upstream side 120 of the filter against contact with air and to thereby maintain the charcoal in the filter in its activated state is not required.

It should also be pointed out that in the embodiment illustrated in FIG. 5 no plug valve is provided for preventing the escape of air or oxygen from air bag 16 once the cover 126 has been separated from filter housing 58. If desired, the cover can be provided with an insert (not shown) at the downstream end of tubular end section 83 which defines a seating surface cooperating with a plug valve in the manner described above.

The construction of escape mask 2 has been described specifically as used on aircraft. It is apparent, however, that the mask can equally effectively be used in other environments where the wearer requires protection against smoke, fumes, toxic gases and/or heat to enable his survival and escape.

We claim:

1. An emergency escape mask apparatus adapted for use in conjunction with and independently of an emergency oxygen supply system comprising:

a mask adapted to be placed over the mouth and nose of a user;

first and second conduit means in fluid communication with each other, the first conduit means being in fluid communication with the mask and the second conduit means being adapted to be in fluid communication with the emergency oxygen supply system;

means for detachably securing the first and second conduit means to each other;

filter means disposed in the first conduit means adapted to remove undesirable substances from air passing therethrough;

means preventing oxygen from the emergency oxygen supply flowing through the first and second conduit means from flowing through the filter means;

and means activated in response to a separation of the first and second conduit means directing ambient air flowing through the first conduit means to pass through the filter means before its reaches the mask to thereby remove from the ambient air the unwanted substances;

whereby the user can inhale cleansed, non-toxic air after the mask has been disconnected from the emergency oxygen supply system.

2. Apparatus according to claim 1 including a hood connected with the mask and the first conduit means, the hood being adapted to be extended over the user's head to protect it against contaminated ambient air and to sheild it from heat, the hood including window means positioned to enable the user to see through the hood.

3. Apparatus according to claim 2 wherein the hood has a sufficient size to cover substantially the entire head of the user so that an edge of the hood overlies the user's neck, and elastic means operatively connected to the hood for urging the hood edge towards the user's neck.

4. Apparatus according to claim 2 wherein the hood is folded in an accordion-like fashion into a relatively narrow strip of overlying hood folds, the hood folds being tightly wrapped about the first conduit means during non-use and storage of the hood.

5. Apparatus according to claim 4 including handle means rigidly attached to the first conduit means for adjusting the relative position of the first conduit means and the mask when applied to the user's face.

6. Apparatus for protecting a person's head during fire, smoke and toxic gas emergencies and enabling the person to selectively breath air supplied by an emergency oxygen supply system or ambient air contaminated with particulates, smoke or toxic gases, the apparatus comprising:

a mask adapted to be placed over the mouth and nose of the person;

first conduit means attached to and in fluid communication with the mask;

second conduit means attached to and adapted to be placed in fluid communication with the emergency oxygen supply system;

means releasably connecting the first and second conduit means so that they are in fluid communications with each other;

a hood adapted to be fully extended over the person's head and to be automatically retained on the head when extended thereover, the hood including a substantially transparent viewing window and being connected with the mask, the hood being tightly folded during non-use about an exterior of the first conduit means and including handle means positioned to be grasped by the user when the user desires to extend the hood over his head;

filter means carried by the first conduit means and adapted to remove from air passing therethrough particulates, smoke and toxic gases; and means operatively connected with the filter means and the first conduit means for requiring ambient airs to first flow through the filter means before it reaches the mask when the person inhales and the first and second conduit means are separated.

7. Apparatus according to claim 6 including flow directing means preventing oxygen from the emergency oxygen supply system from flowing through the filter means when the first and second conduit means are attached to each other.

8. Apparatus according to claim 6 wherein the filter means comprises activated charcoal, and including means operatively associated with the filter means for preventing contact between ambient air and the activated charcoal during non-use and storage of the apparatus.

9. Apparatus according to claim 6 wherein folds formed by the hood extend in a crescent-shape partially about the first conduit means, and including an elongated, relatively rigid handle, projecting substantially radially from the first conduit means and positioned intermediate ends of the crescent-shaped hood folds.

10. A head protecting breathing apparatus for use in fire and smoke emergencies adapted to be operated in conjunction with an emergency oxygen supply and independently, the apparatus comprising:

a mask adapted to be placed over the head and nose of a person;

a generally tubular filter-valve assembly having a downstream end in fluid communication with the mask and an upstream end adapted to be connected to the oxygen supply, the filter-valve assembly comprising first and second conduit means coaxially and detachably secured to each other, the first conduit means including radially oriented, axially spaced first and second flow passages communicating with an interior of the mask, an annular filter element disposed about the first conduit means and axially movable relative thereto over at least a portion of the length thereof, so that the filter element can alternatively cover one or the other of the first and second flow passages, means operatively associated with the first conduit means urging the filter means into a position in which it covers the first flow passage, and means preventing the urging means from axially moving the filter means past an end of the first conduit means;

means operatively associated with the second conduit means for moving the filter means in oppostion to the urging means into a position in which the filter means covers only the second flow passage when the first and second conduit means are operatively connected, and housing means connected with the first conduit means and guiding air flowing generally axially through the filter means in a downstream direction towards the mask to the second flow passage when the filter means is in the position covering the first flow passage;

a hood assembly constructed of a heat resistant, flexible material sized to substantially completely envelope the person's head and to extend to about the person's neck when applied thereover, the hood assembly including means urging the portion of the hood in the vicinity of the person's neck towards the neck, a window constructed of a substantially transparent, heat resistant material applied over a cutout in the hood positioned to be in substantial alignment with the person's eye when the hood is applied over his head, the hood being folded into generally zigzag-shaped folds and wrapped about the housing means in a generally crescent-shaped configuration so that ends of the folds are spaced apart, readily breakable holding means interconnecting the ends of the crescent-shaped folds wrapped about the housing means for retaining the folds about the housing means, and a handle applied to a last fold of the hood and positioned about midway from the fold ends for pulling the hood folds away from the housing means by breaking the holding means to thereby enable the positioning of the hood over the person's head; and a mask and hood positioning handle substantially rigidly projecting from the housing means in a radial direction from a point substantially, diametrically opposite from the hood handle permitting the person to adjust the mask and the hood while applied to his head;

whereby the person can breathe air from the emergency oxygen supply, while the first and second conduit means are attached to each other, which flows from the supply through the second conduit means, the first flow passage in the first conduit means and the first conduit means to the mask; and whereby the person can separate the mask, the hood and the first conduit means from the emergency oxygen supply by separating the first and second conduit means which causes movement of the filter means to the first position and which permits the person to inhale air, from the exterior of the mask and the hood, which must flow through the filter means, is cleansed of unwanted substances therein, and hence through the second flow pasage into the first conduit means and to the mask.

11. Apparatus according to claim 10 including valve means operatively connected with the second conduit means, means for maintaining the valve means in an open position so long as the first and second conduit means are secured to each other to permit passage of air from the oxygen supply system to the second and first conduit means, and means closing the valve means in response to the separation of the first and second conduit means to thereafter prevent the flow of air from the emergency oxygen supply to the second conduit means and hence to the surrounding atmosphere.

12. Apparatus according to claim 10 wherein the filter means comprises activated charcoal.

13. Apparatus according to claim 11, wherein the filter means comprises inner and outer, tubular bushings constructed of an air impervious material, and wherein the charcoal is disposed between the bushings.

14. Apparatus according to claim 10 wherein the urging means comprises a plurality of equally spaced compression springs disposed between a downstream side of the filter means and the housing means.

15. Apparatus according to claim 10 including means for securing the housing means and the second conduit means to each other.

16. Apparatus according to claim 15 wherein the securing means comprises adhesive tape wrapped about a periphery of the housing means and the second conduit means and overlying a groove formed between the housing means and the second conduit.

17. Apparatus according to claim 16 including string means disposed in the groove having a first end anchored in the groove and a second end extending out of the groove to the exterior of the housing means and the second conduit means, whereby the adhesive tape can be broken along the groove and the housing means and the second conduit means can be separated by pulling on the end of the string extending to the exterior and thereby cutting the adhesive tape.

18. Apparatus according to claim 17 including a generally axially-oriented notch defined in the second conduit means, communicating with the groove and holding a section of the string extending from the groove to the exterior of the second conduit means.

19. Apparatus according to claim 18 including a pull handle sized to be grasped by the person using the mask and attached to the end of the string on the exterior of the second conduit means.

20. Apparatus according to claim 10 wherein the second conduit means includes exhaust port means communicating the interior of the mask with the exterior thereof, and valve means operatively associated with the exhaust port means permitting a flow of air from the mask to the exterior thereof and preventing a flow of air in the reverse direction.

21. Apparatus according to claim 20 including inlet check valve means cooperatively associated with the first conduit means and permitting air flow in a downstream direction from the first conduit means to the interior of the mask and preventing a flow of air from the mask in the reverse direction towards the first conduit means.

* * * * *

UNITED STATES PATENT AND TRADEMARK OFFICE

CERTIFICATE OF CORRECTION

PATENT NO. : 4,793,342

DATED : December 27, 1988

INVENTOR(S) : Terry M. Haber, Romeo Le Marie

It is certified that error appears in the above-identified patent and that said Letters Patent is hereby corrected as shown below:

Title page:

In the line beginning with [73] Assignee: Terry McGovern Gaber, please delete "Gaber" and insert therefor --Haber--

Signed and Sealed this

Second Day of May, 1989

*Attest:*

*Attesting Officer*

DONALD J. QUIGG

*Commissioner of Patents and Trademarks*